US006321404B1

(12) United States Patent
Tsai

(10) Patent No.: US 6,321,404 B1
(45) Date of Patent: Nov. 27, 2001

(54) BUILT-UP AIR CUSHION

(76) Inventor: Jen Hsiu Tsai, 2F-3, No. 11, Lane 250, Sec. 5, Nan King E. Rd., Taipei (TW)

( * ) Notice: Subject to any disclaimer, the term of this patent is extended or adjusted under 35 U.S.C. 154(b) by 0 days.

(21) Appl. No.: 09/299,626

(22) Filed: Apr. 27, 1999

(30) Foreign Application Priority Data

Jul. 15, 1998 (TW) ..... 87211377

(51) Int. Cl.[7] ..... A47C 27/00
(52) U.S. Cl. ..... 5/655.3; 5/710; 5/654
(58) Field of Search ..... 5/655.3, 654, 644, 5/706, 708, 710, 713

(56) References Cited

U.S. PATENT DOCUMENTS 4,722,105 * 2/1988 Douglas ..... 5/710
5,267,364 * 12/1993 Volk ..... 5/710
5,369,828 12/1994 Graebe .
5,502,855 4/1996 Graebe .
5,634,225 * 6/1997 Miller et al. ..... 5/710
5,745,941 * 5/1998 Miller ..... 5/710
5,991,949 * 11/1999 Miller et al. ..... 5/710

* cited by examiner

*Primary Examiner*—Lynne H. Browne
*Assistant Examiner*—Fredrick Conley
(74) *Attorney, Agent, or Firm*—Rabin & Berdo, P.C.

(57) ABSTRACT

A built-up air cushion mainly includes a bottom wall and a plurality of inflatable units separately and detachably connected to the bottom wall. The inflatable unit each includes a base on which suitable numbers of air cells are provided. Each inflatable unit is provided at the base with an air inlet for inflating or bleeding the air cells in order to adjust an air pressure in each inflatable unit to meet actual need, or to deflate the inflatable units for convenient storage of the air cushion. While the inflatable units may be massively manufactured with only one type of mold at reduced cost, air cushions of different sizes and shapes may be easily formed by attaching desired numbers of inflatable units to bottom walls having desired sizes and shapes.

11 Claims, 10 Drawing Sheets

BUILT-UP AIR CUSHION

FIELD OF THE INVENTION

The present invention relates to a built-up air cushion, and more particularly to an air cushion formed from a plurality of individual inflatable units that are detachably and selectively connected to a bottom wall depending on actual need of a user.

BACKGROUND OF THE INVENTION

Most of conventional chair cushions and bed mattresses include a cover or case into which a whole piece of sponge, foamed rubber or other similar elastic material stuffed. Such conventional cushions and/or mattresses prevent users from directly contacting with the rigid chairs and/or beds, so that the users may comfortably sit or lie on the chairs or the beds. A disadvantage of such conventional cushions and mattresses stuffed with sponge or foamed rubber is they have poor air permeability. A patient lying on bed with such conventional cushion or mattress for a prolonged time will suffer from skin problems, such as bedsore.

An inflatable cushion 30 shown in FIG. 10 has been developed in an attempt to overcome the above-mentioned disadvantage of the conventional stuffed cushions. The inflatable cushion 30 mainly includes a bottom wall 32 made of rubber material, and an integrally formed air cushion having a plurality of communicable air cells 34. Air filled in the air cells 34 provides a suitable air pressure inside the air cushion to allow the same to bear the weight of a user sitting or lying on the cushion. Such inflatable cushion 30 has better air permeability than the conventional stuffed cushions to advantageously avoid undesirable bedsore or other skin problems.

U.S. Pat. No. 5,502,855 discloses a zoned cellular cushion that has a series of separately inflatable zones with tubular conduits leading from each zone beneath or on top of the cushion within the periphery of the cushion to a common manifold spaced outwardly from the front edge of the cushion with a fill tube connected to the manifold and individual cut-off valves or a means to buckle the tubes for each conduit, whereby the zones can be filled and bled simultaneously or selectively.

U.S. Pat. No. 5,369,828 discloses an inflatable cushion with upstanding pyramidal air cells. The inflatable cushion disclosed in this patent includes a flexible bottom wall and a plurality of upstanding air cells having flexible generally vertical side walls. The air cells is substantially pyramidal in shape and has a substantially rectangular flexible lower section defined by the vertical side walls and sealed to the bottom wall, and a flexible domed tapered top area connected to the vertical side walls. The side walls of adjacent cells are separated and spaced apart to define lateral and longitudinal paths and are independently upstanding when inflated. And there are tubing connected to the air cells through the bottom wall to adjust and monitor the air pressure in the cells from beneath the cushion.

Following are some drawbacks existing in the above-described conventional inflatable cushion 30:

1. The air cells 34 of the inflatable cushion 30 are integrally formed onto a top of the bottom wall 32. Separate molds are required to manufacture inflatable cushions 30 having different sizes and different numbers of air cells 34 and therefore largely increase the manufacturing cost of such inflatable cushion 30.

2. The conventional inflatable cushion 30 is integrally molded. However, molds for forming the inflatable cushion 30 have limitations in their sizes. Therefore, it is not possible to manufacture an inflatable cushion 30 having a considerably large area, such as a cushion for use as a bed mattress. That is, the inflatable cushion 30 has only limited usage, such as a chair cushion having small area.

3. A finished inflatable cushion 30 has fixed dimensions and unchangeable arrangement of the air cells 34 on the bottom wall 32. Moreover, since the air cells 34 are communicable with one another, the inflatable cushion 30 is not foldable to change its size for use on a smaller chair or wheelchair. In other words, an inflatable cushion 30 can only be used on a chair seat having a size similar to or larger than that of the bottom wall 32 of the inflatable cushion 30.

4. Although the inflatable cushion 30 may prevent a patient lying thereon from bedsore, it does not help a patient who has already suffered from bedsore and/or other illnesses in connection with, for example, the backbone. In a worse condition, the inflatable cushion 30 might even cause worsened bedsore and/or spine disease. The time and occasion suitable for using the inflatable cushion 30 is therefore limited, too.

5. Since the air cells 34 are communicable with one another, any leak on any of the air cells 34 shall make the whole inflatable cushion 30 useless and undesirably shortens the usable life of the inflatable cushion 30.

SUMMARY OF THE INVENTION

It is therefore a primary object of the present invention to provide a built-up air cushion having separated inflatable units that are detachably connected to a bottom wall to form the air cushion. Air cushion of different sizes and/or shapes may be easily formed from different numbers of inflatable units attached to the bottom wall almost without any limitation. Therefore the built-up air cushion may be made for widely using on chair, bed or wheelchair in any size or shape.

Another object of the present invention is to provide a built-up air cushion having separated and identical inflatable units so that only one type of mold is required to produce the inflatable units for forming air cushions of any desired size and/or shape. The cost for manufacturing the air cushion can therefore be largely reduced.

A further object of the present invention is to provide a built-up air cushion having separated inflatable units that are selectively and detachably attached to a bottom wall of the air cushion at selected areas to meet specific needs.

A still further object of the present invention is to provide a built-up air cushion having separated inflatable units that are provided with an air inlet each for inflating or bleeding the inflatable units in order to adjust air pressure inside the inflatable units depending on a user's actual need, or to deflate the inflatable units for convenient storage of the cushion when the same is not in use.

BRIEF DESCRIPTION OF THE DRAWINGS

The above and other objects and the structure and features of the present invention may be best understood by referring to the following detailed description of the preferred embodiments and the accompanying drawings, wherein.

DETAILED DESCRIPTION OF THE PREFERRED EMBODIMENTS

Figure 1:
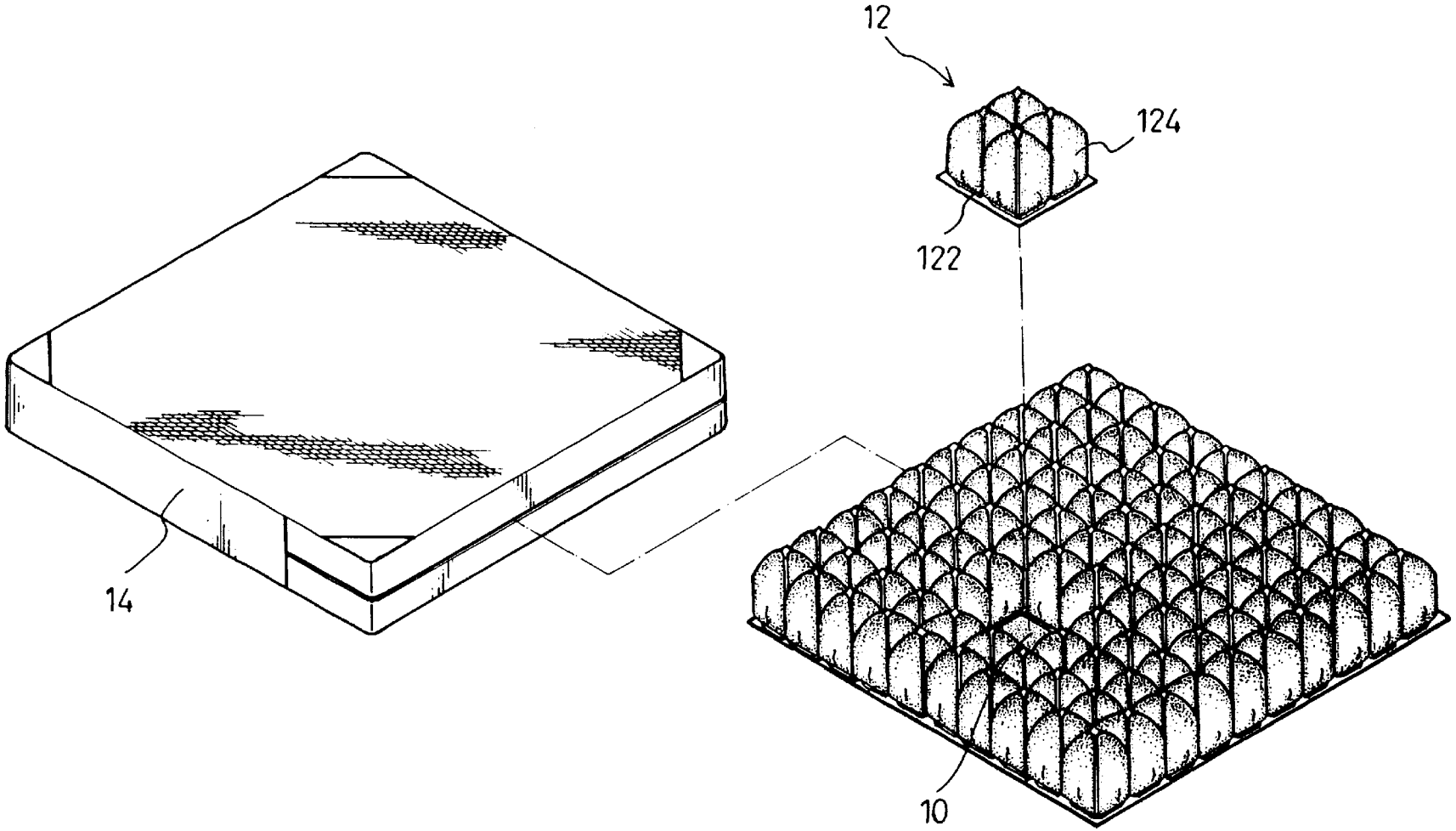
FIG. 1 is a partially exploded perspective of a built-up air cushion according to the present invention.
Figure 2:
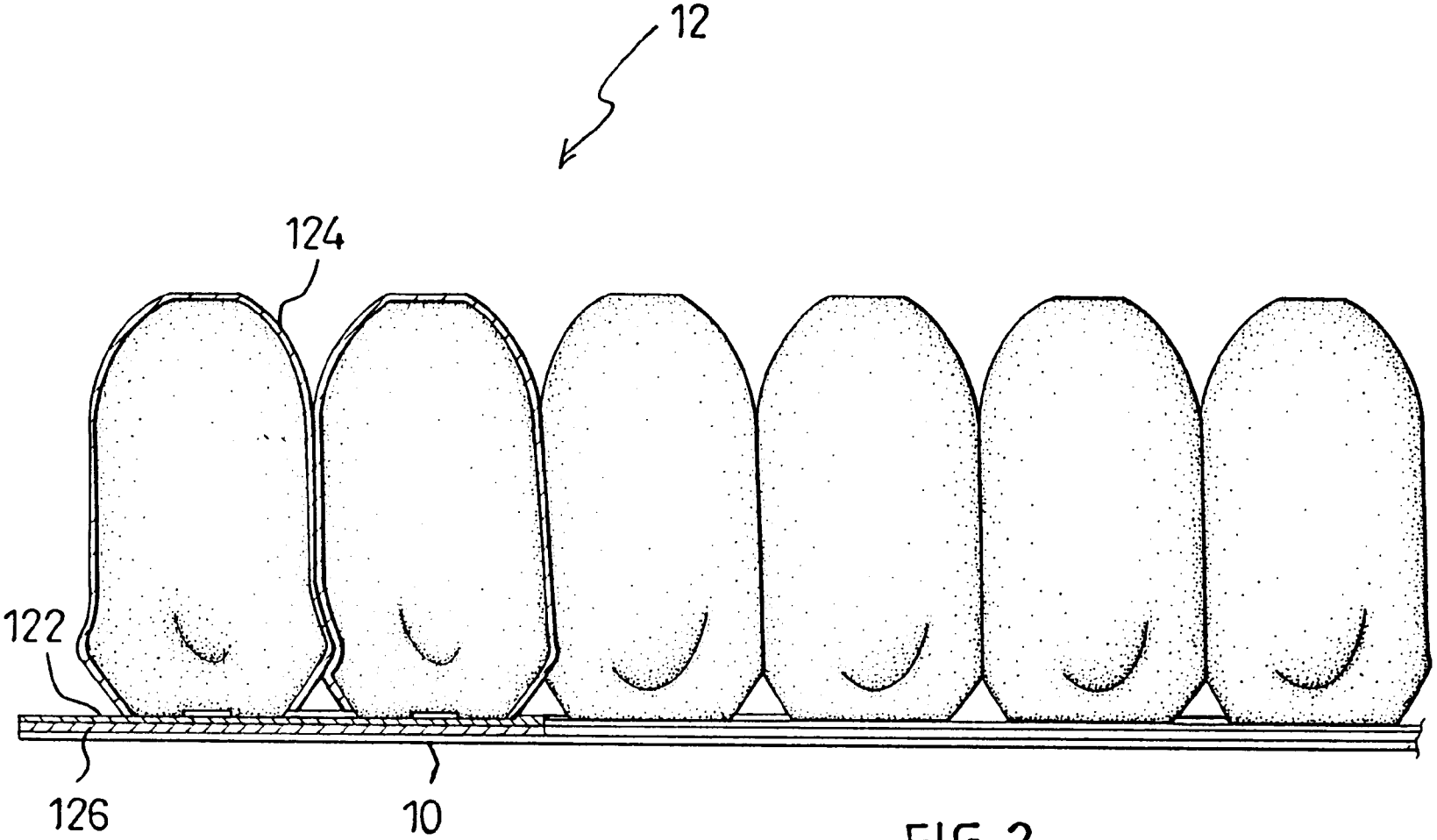
FIG. 2 is a fragmentary sectional view of the air cushion of FIG. 1.
Figure 6:
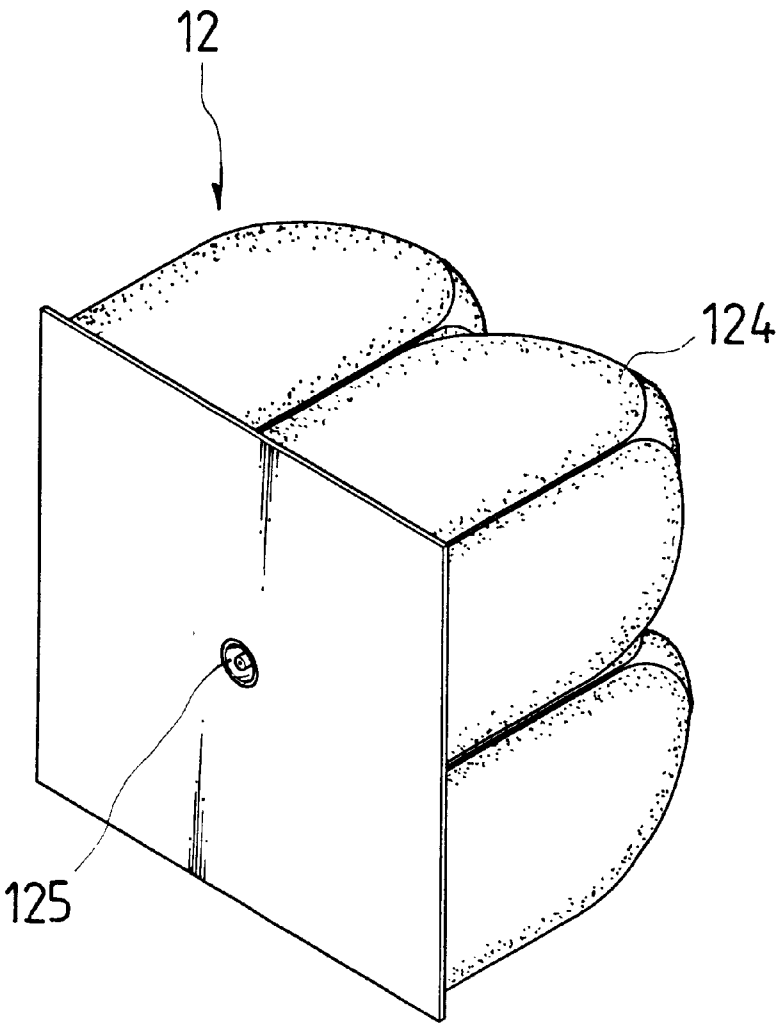
FIG. 6 is an enlarged bottom perspective view of one single inflatable unit of the built-up air cushion of FIG. 1 to show an air inlet thereof.

Please refer to FIGS. 1 and 2 that are partially exploded perspective and fragmentary sectional views, respectively, of a built-up air cushion according to the present invention. As shown, the air cushion of the present invention mainly includes a bottom wall 10, on a top of which a plurality of inflatable units 12 are provided. Each inflatable unit 12 includes a base 122 and more than one integrally molded hollow air cells 124 fixed to a top surface of the base 122. It is preferable that four air cells 124 are provided for each inflatable unit 12. However, it is understood that other numbers of air cells 124 on one inflatable unit 12, such as two, six, nine, etc., may also be selected. In the illustrated embodiment of the present invention, each inflatable unit 12 has four air cells 124 provided thereon. It is also preferable that the base 122 of the inflatable unit 12 is square in shape. The air cells 124 in the same inflatable unit 12 may be or may not be communicable with one another. In the case of communicable air cells 124 in the same inflatable unit 12, an air inlet 125 is provided at a bottom surface of the base 122 of each inflatable unit 12, as shown in FIG. 6. Fastening means 126, such as a Velcro (hook and loop fastener) tape, is provided at the bottom surface of the base 122 of each inflatable unit 12. Desired numbers of inflatable units 12 may therefore be easily detachably attached to the top of the bottom wall 10 to form a complete piece of built-up air cushion no matter what shape and what size the bottom wall 10 is in.

Figure 3:
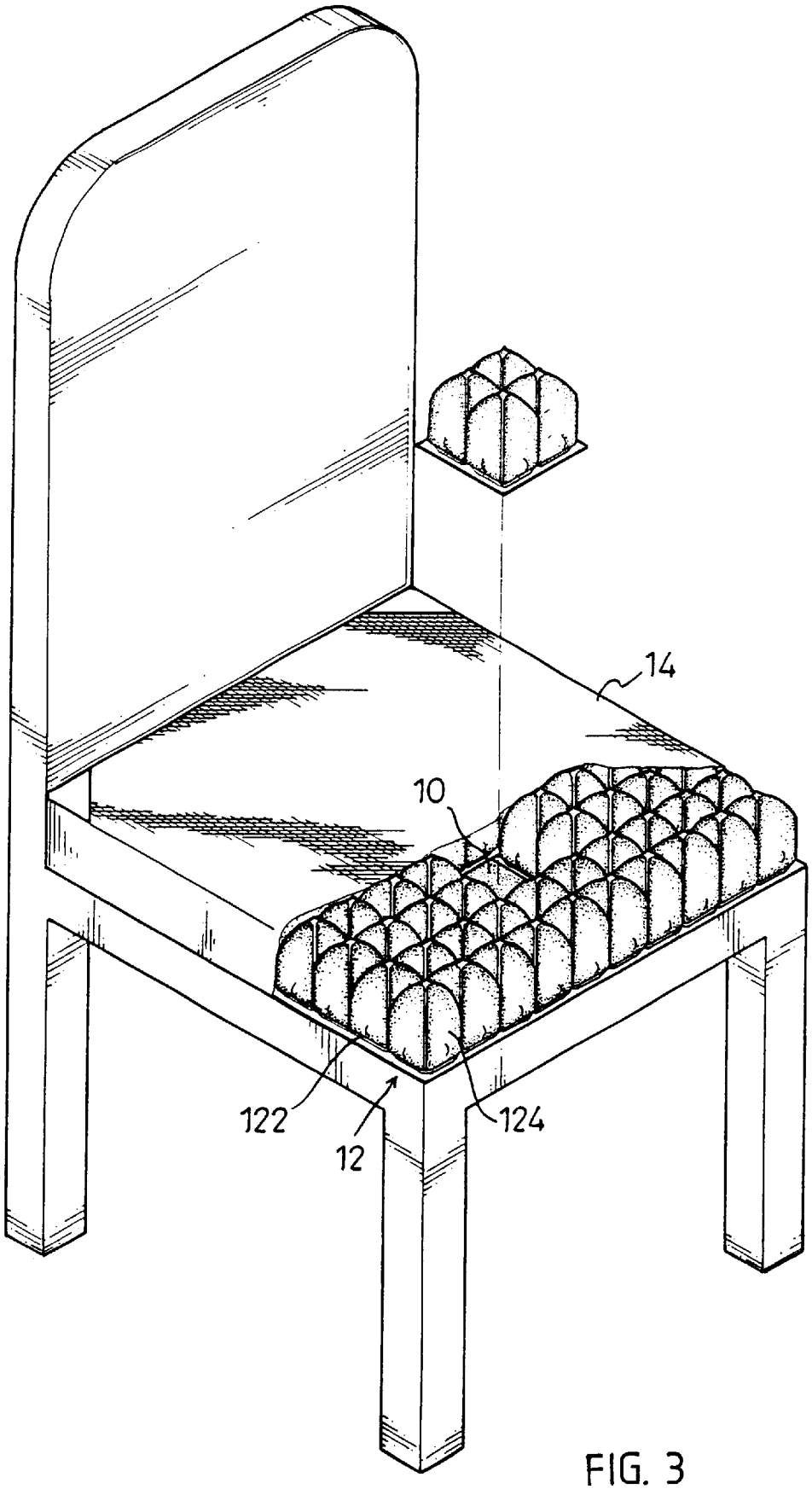
FIG. 3 is a perspective showing the built-up air cushion of the present invention being used as a chair cushion.
Figure 4:
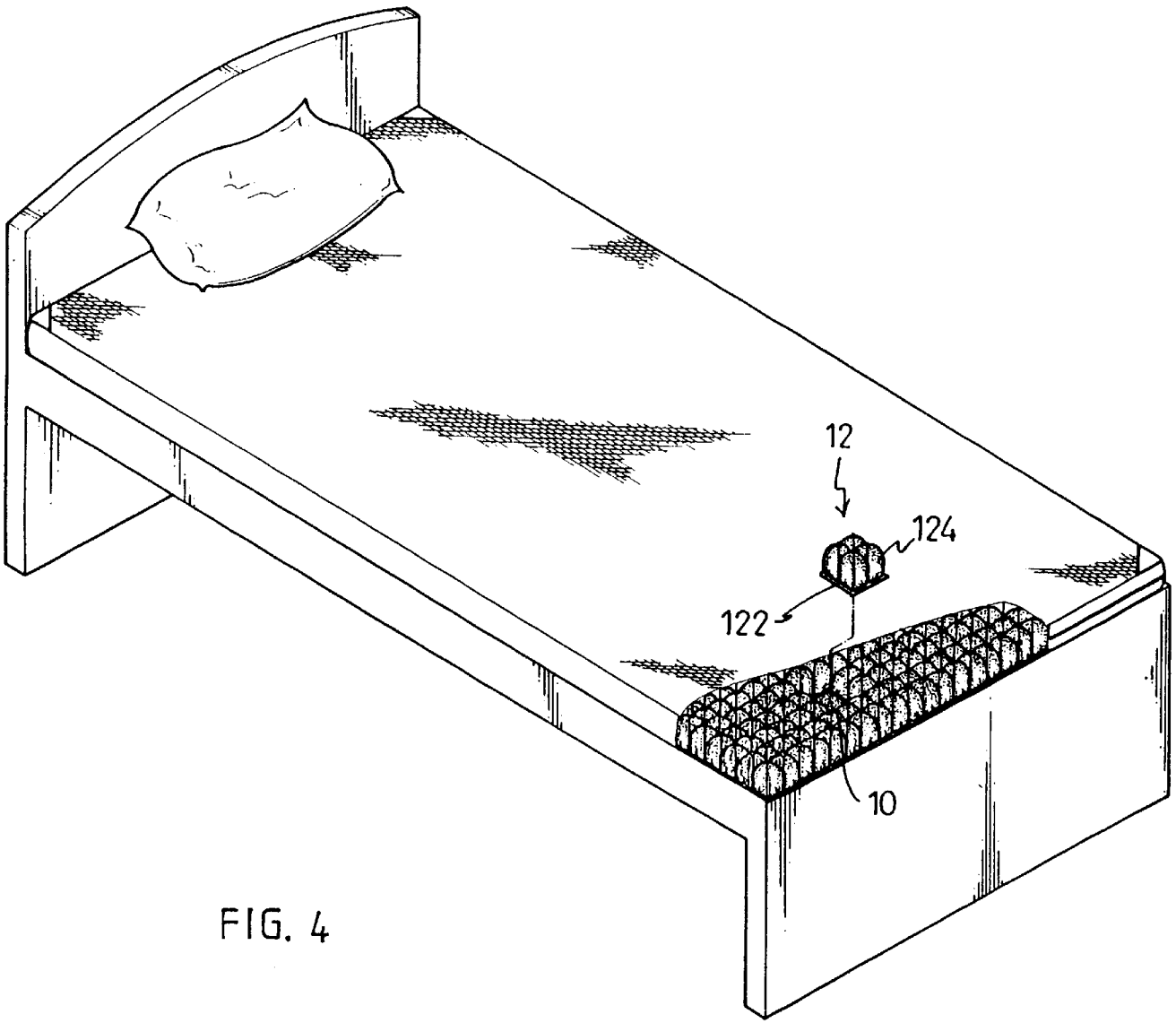
FIG. 4 is a perspective showing the built-up air cushion of the present invention being used as a bed mattress.

After a plurality of inflatable units 12 are attached to the top of a bottom wall 10 having specific size and shape, the inflatable units 12 and the bottom wall 10 are enclosed in a suitably sized cover 14 to either form a chair cushion having a small area for use on a chair or a wheelchair, as shown in FIG. 3, or a mattress having a large area for use on a bed, as shown in FIG. 4. Cushions or mattresses formed in this manner may have differently sized and shaped bottom walls 10 and different numbers of inflatable units 12, but the inflatable units 12 forming the cushions or mattresses always have identical size and structure. Therefore, only one type of mold is required to massively manufacture the inflatable units 12 that cooperate with differently sized and shaped bottom walls 10 to form cushions and mattresses of different sizes and shapes. Numbers of molds and costs thereof needed to manufacture the air cushions of the present invention are therefore largely reduced. Being free in size and shape, the air cushion of the present invention can therefore be widely used in different manners.

To meet the need of a patient suffering from bedsore, piles or the like, inflatable units 12 of the built-up air cushion of the present invention at positions generally corresponding to the painful areas of the patient sitting or lying on the cushion may be removed from the bottom wall 10, as shown in FIGS. 3 and 4, lest the bedsore or piles should become worsened due to contact with the air cushion for a prolonged time.

Figure 5:
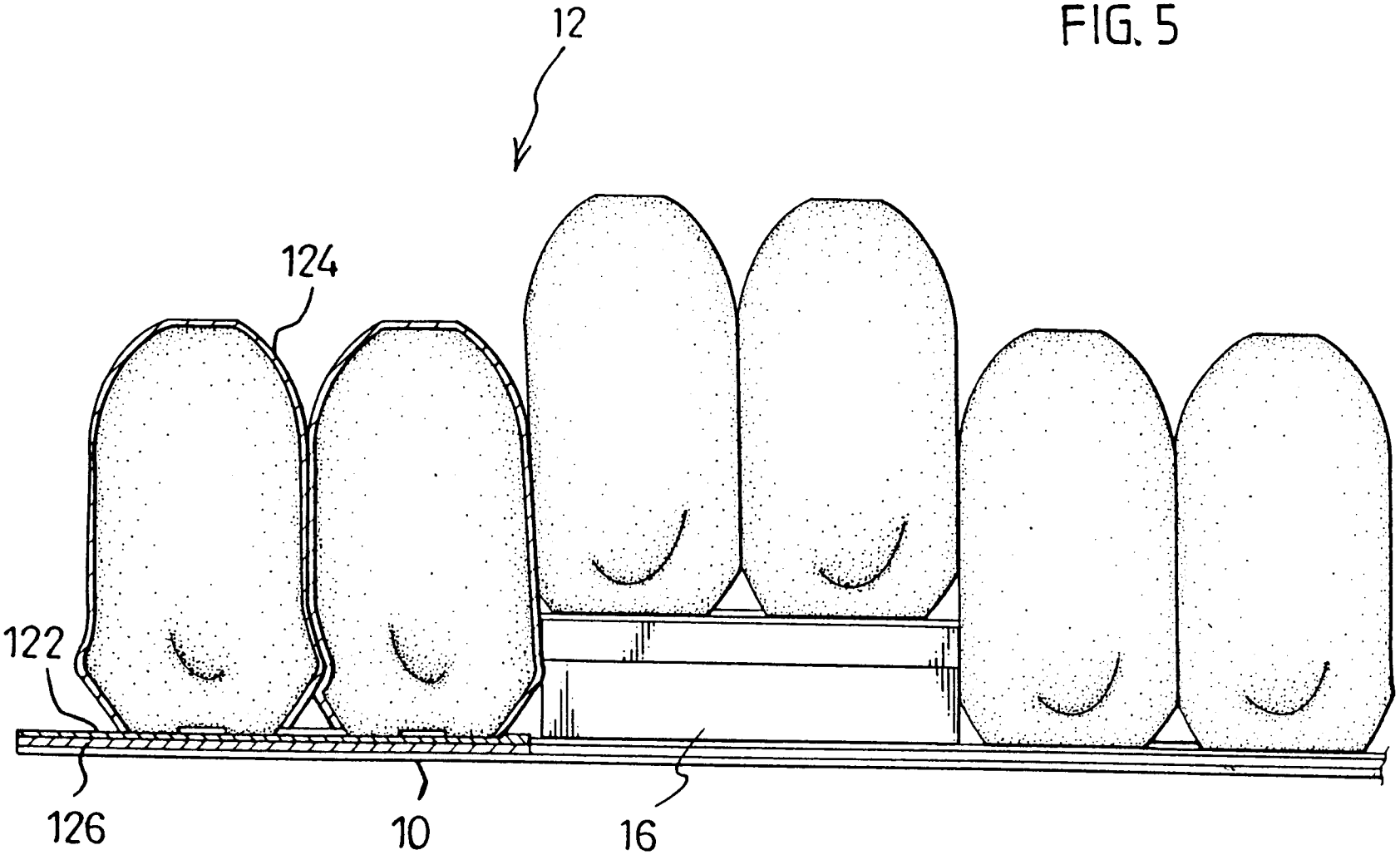
FIG. 5 is a fragmentary sectional view showing the manner of raising an individual inflatable unit of the built-up air cushion of FIG. 1.

There is also patient having injured ischium due to accident. Such patient usually needs to sit or lie with his or her body inclined to one side to somewhat relieve the pain caused by the injured ischium. However, such inclined sitting or lying position will adversely compress the patient's breast and prevent the patient from breathing smoothly. To allow such patient to comfortably sit or lie on a chair or a bed, one or more pads 16 may be disposed between the bottom wall 10 and the inflatable units 12 at positions generally corresponding to the patient's injured ischium, as shown in FIG. 5. By this way, some of the inflatable units 12 on the air cushion are slightly higher than other inflatable units 12 to advantageously support the patient's inclined body, so that the patient may easily keep his or her body in a balanced condition on the air cushion. The numbers, positions, and thickness of the pads 16 for raising the inflatable units 12 may be changed or adjusted depending on the patient's actual need, so that the patient's sitting or lying position may be best corrected to ensure the patient's health.

Figure 7:
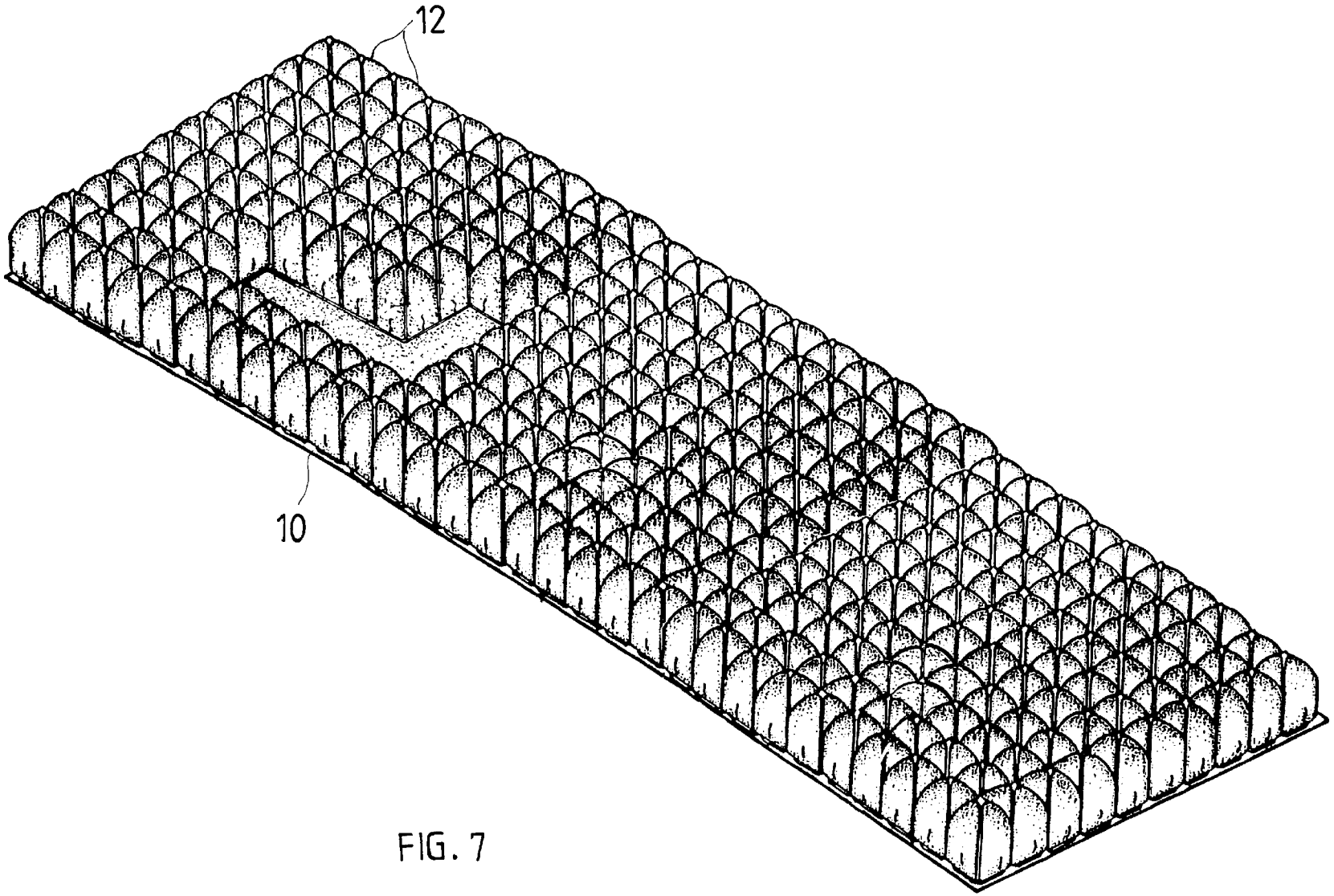
FIG. 7 shows that inflatable units of the built-up air cushion of the present invention can be selectively connected to a bottom wall of the air cushion to meet specific usage.

By properly removing adequate numbers of inflatable units 12 at suitable positions from the bottom wall 10 of the air cushion of the present invention, as shown in FIG. 7, the air cushion may also be used as a bed mattress particularly suitable for a patient suffering from curvature of spine or protrusion of lumbar intervertebral disc.

Figure 8:
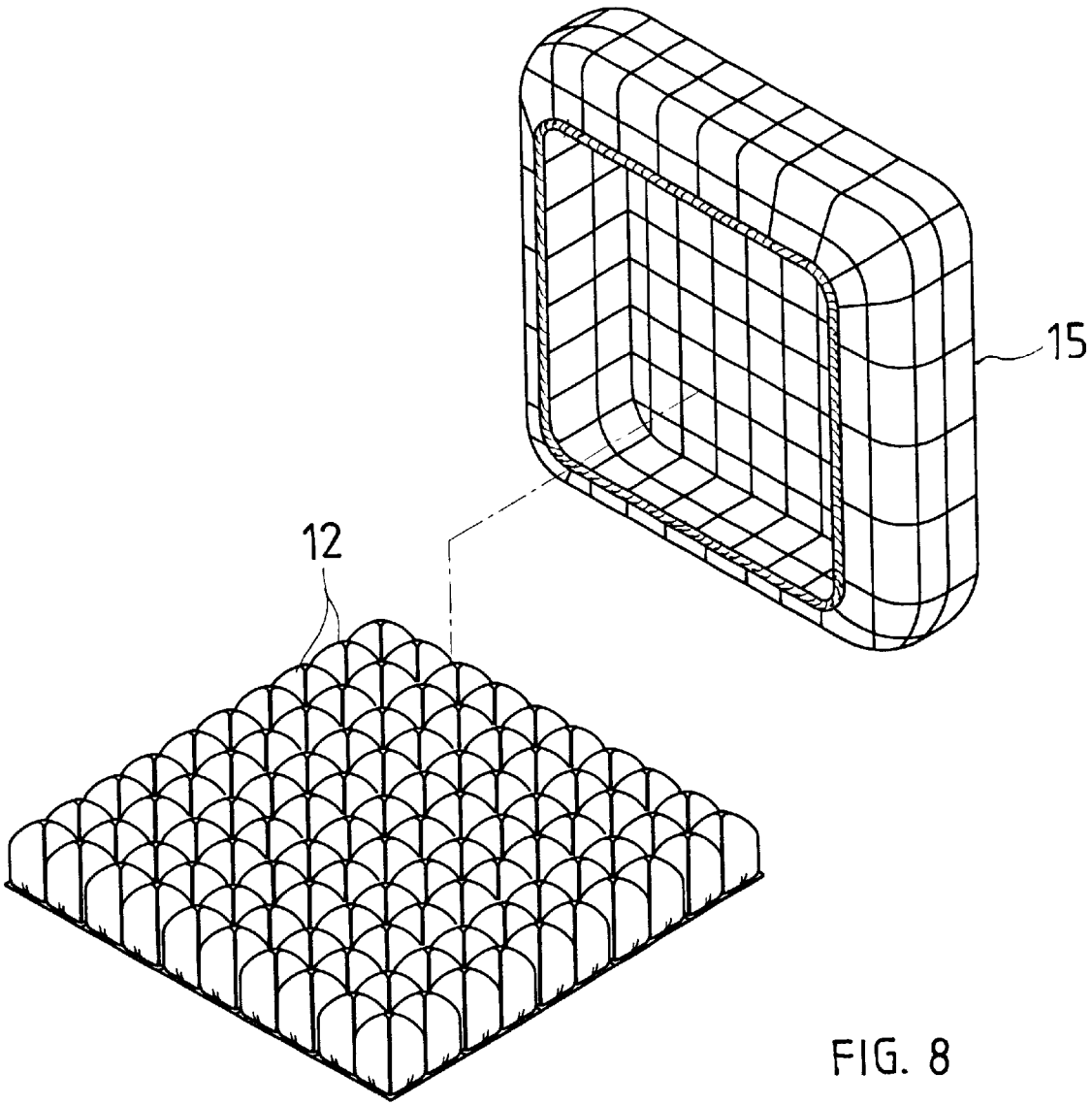
FIG. 8 is an exploded perspective showing another manner of using the built-up air cushion of the present invention.
Figure 9:
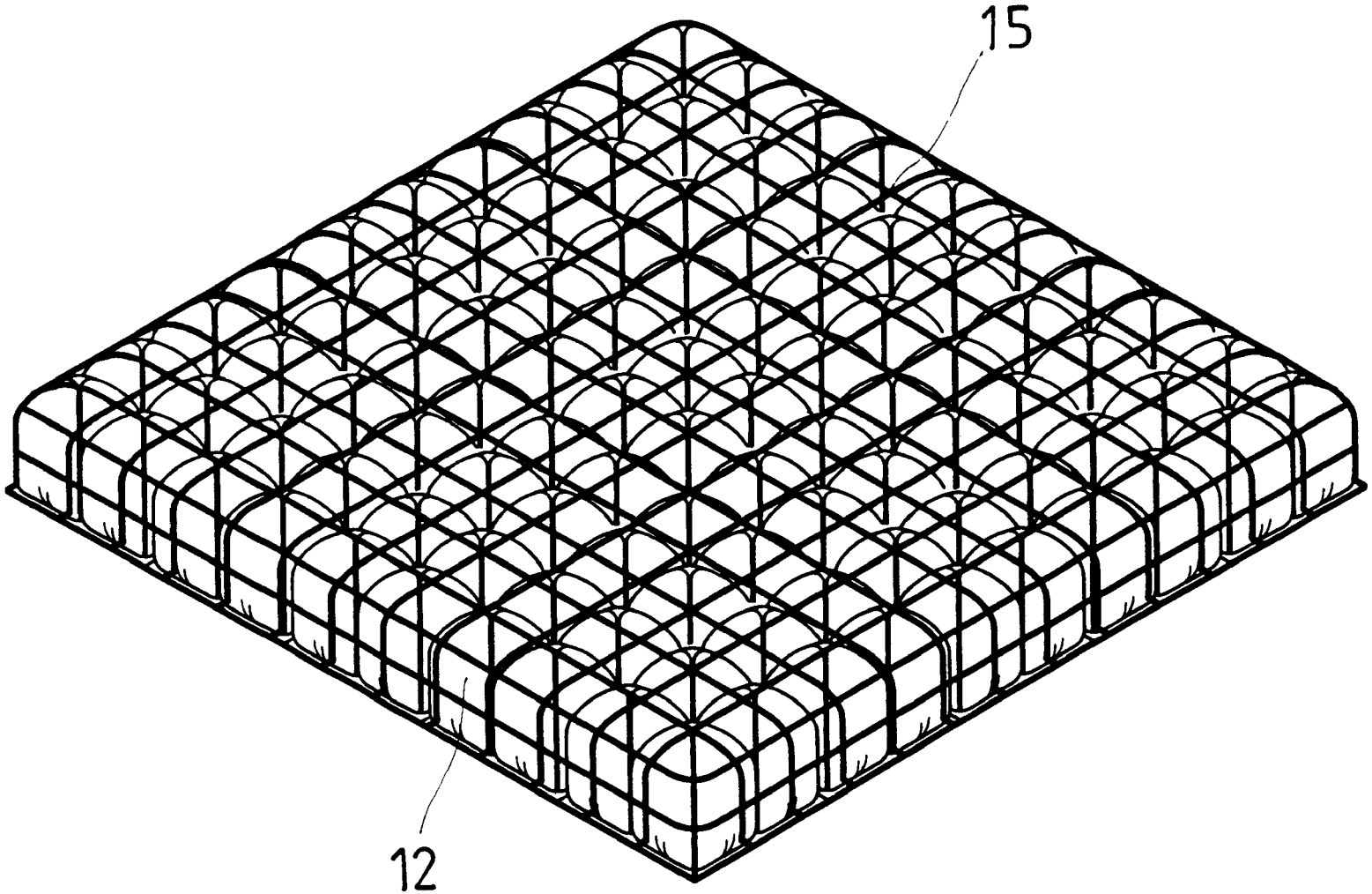
FIG. 9 is an assembled perspective of the built-up air cushion of FIG. 8.
Figure 10:
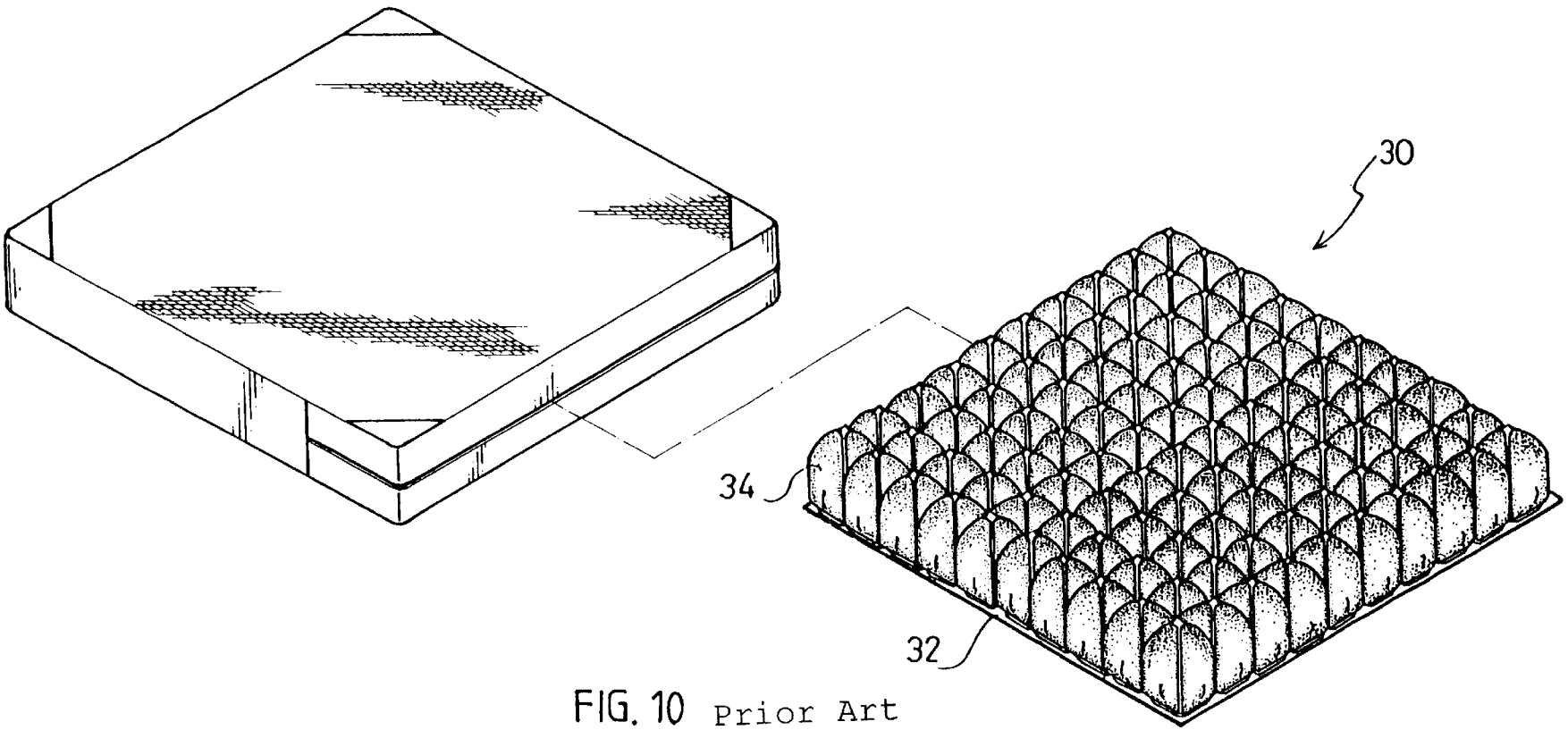
FIG. 10 Prior Art
FIG. 10 is a perspective of a conventional air cushion.

In another embodiment of the present invention, the inflatable units 12 and the bottom wall 10 are enclosed in a cover in the form of a net 15 having suitable elasticity and open meshes, as shown in FIGS. 8 and 9. The elasticity and open meshes of the net 15 allow the air cushion of the present invention to have even better gas permeability and be more suitable for users who need to use the air cushion for a prolonged time or suffer from skin problems.

Following are some of the advantages of the present invention:

1. The air cushion of the present invention is formed by detachably attaching any desired numbers of inflatable units 12 to the bottom wall 10 without any limitation in its size and shape. The air cushion may have a size as small as a chair cushion or as large as a bed mattress, completely depending on a user's actual need. The air cushion of the present invention is therefore not restricted by the size of its mode and can be widely used in different manners.

2. Since air cushions of different sizes and shapes may be formed by attaching any desired numbers of dimensionally and structurally identical inflatable units 12 to the bottom wall 10 having desired size and shape, it is not necessary to make different molds for producing differently sized and shaped air cushions. The air cushion of the present invention can therefore be massively manufactured from only one type of mold at reduced cost.

3. A big air cushion of the present invention may be reduced in size simply by removing inflatable units 12 at outer periphery of the air cushion from the bottom wall 10 and bend or cut off unnecessary part of the bottom wall 10 to a desired smaller size and shape. The air cushion of the present invention can therefore be more flexibly used for different purposes.

4. The size of the mold for making the inflatable unit 12 is not a problem in manufacturing the built-up air cushion of the present invention, the air cushion can therefore have as big size as possible for use as a bed mattress instead of being limited to serve as chair cushions that have smaller sizes.

5. Inflatable units 12 on the bottom wall 10 may be selectively removed from the air cushion to meet specific needs of some patients, such as those suffering from bedsore, piles, curvature of spine, and/or protrusion of lumbar intervertebral disc. The air cushion of the present invention therefore has increased functions and values.

6. The inflatable units 12 are independent from one another. Any leak on any inflatable unit 12 would not make the whole air cushion of the present invention useless. And, a damaged or broken inflatable unit 12 may be easily replaced with a new and good one without adversely affecting the performance or shortening the usable life of the whole air cushion.

7. Each inflatable unit 12 is provided with an air inlet for easily inflating or bleeding the inflatable unit to adjust air pressure of the air cushion at different areas, or to deflate the air cushion for convenient storage of it without occupying too much space.

What is claimed is:

1. A built-up air cushion, comprising:

a bottom wall; and a plurality of independent inflatable units separately detachably attached to a top surface of said bottom wall, each of said inflatable units including an essentially square base having four equal sides and a plurality of air cells provided on a top surface of said base, said base being provided at a bottom surface thereof with fastening means for detachably connecting said inflatable unit to said top surface of said bottom wall, wherein said units are positionable relative to one another on said bottom wall so that when a first one of said units is attached to said bottom wall, another one of said units is positionable adjacent to one of said sides of said first one of said units, and a further one of said units is positionable adjacent to another one of said sides of said first one of said units that is perpendicular to the one of said sides.

2. A built-up air cushion as claimed in claim 1, wherein said a plurality of air cells provided on each said base of said inflatable unit are communicable with one another.

3. A built-up air cushion as claimed in claim 2, wherein said fastening means provided at the bottom surface of said base of said inflatable unit is a hook and loop fastener tape.

4. A built-up air cushion as claimed in claim 1, wherein said a plurality of air cells provided on each said base of said inflatable unit are not communicable with one another.

5. A built-up air cushion as claimed in claim 4, wherein said fastening means provided at the bottom surface of said base of said inflatable unit is a hook and loop fastener tape.

6. A built-up air cushion as claimed in claim 1, wherein said base of each said inflatable unit is provided with four said air cells.

7. A built-up air cushion as claimed in claim 1, further comprising adjusting pads suitable for selectively disposed between said bottom wall and said inflatable units at selected areas on said air cushion depending on actual need.

8. A built-up air cushion as claimed in claim 1, wherein each said inflatable unit is provided with an air inlet via which said inflatable unit is individually and selectively inflated or bled as necessary.

9. A built-up air cushion as claimed in claim 8, wherein said air inlet is provided at the bottom surface of said base of said inflatable unit.

10. A built-up air cushion as claimed in claim 1, wherein said inflatable units are connectable to the bottom wall to collectively and selectively form a plurality of different geometric configurations defined by a placement of said inflatable units.

11. A built-up air cushion as claimed in claim 1, wherein said plurality of air cells and said base of each said inflatable unit are integrally-formed.

* * * * *